US005419068A

United States Patent [19]

Pages et al.

[11] Patent Number: 5,419,068

[45] Date of Patent: May 30, 1995

[54] WEAPON TRIGGER LOCK

[76] Inventors: Darrin A. Pages; Melissa C. Pages, both of 591 Camelia St., Atlantic Beach, Fla. 32233

[21] Appl. No.: 299,275

[22] Filed: Sep. 1, 1994

[51] Int. Cl.[6] ..... F41A 17/54

[52] U.S. Cl. ..... 42/70.07

[58] Field of Search ..... 42/70.07, 70.11

[56] References Cited

U.S. PATENT DOCUMENTS

| | | | |
|---|---|---|---|
| 4,488,370 | 12/1984 | Lemelson | 42/70.11 |
| 4,499,681 | 2/1985 | Bako et al. | 42/70.07 |
| 5,283,971 | 2/1994 | Fuller et al. | 42/70.07 |

*Primary Examiner*—Charles T. Jordan
*Assistant Examiner*—Theresa M. Wesson

[57] ABSTRACT

A weapon trigger lock comprising a housing formed of a primary section having an actuatable key extended therefrom and a separate secondary section having a key tumbler and with the key releasably coupled to the key tumbler for preventing access to a trigger and trigger guard of a weapon disposed between the sections; memory circuitry coupled to the housing and having a write mode for receiving and storing an access code signal and a read mode for transmitting a stored access code signal; keypad circuitry coupled the housing for receiving an input access code and transmitting an access code signal; comparator circuitry coupled to the housing for receiving the access code signal and the stored access code signal and transmitting a solenoid activation signal when the received signals are equal; solenoid circuitry coupled to the housing for releasing the key upon receipt of the solenoid activation signal; and a power source mechanism coupled the housing for supplying electrical energy to the circuitry.

4 Claims, 4 Drawing Sheets

WEAPON TRIGGER LOCK

BACKGROUND OF THE INVENTION

1. Field of the Invention

The present invention relates to a weapon trigger lock and more particularly pertains to preventing unauthorized access to a trigger of a weapon with a weapon trigger lock.

2. Description of the Prior Art

The use of trigger locks is known in the prior art. More specifically, trigger locks heretofore devised and utilized for the purpose of preventing access to a weapons trigger are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,616,559 discloses a firearm trigger lock fitting on the trigger guard. U.S. Pat. No. 3,956,842 to Ballenger discloses a gun trigger lock. U.S. Pat. No. 4,213,263 to Brouthers discloses a firearm trigger guard assembly. U.S. Pat. No. 5,191,158 to Fuller et al discloses a trigger guard for a firearm. U.S. Pat. No. 5,241,583 to Martensson discloses a portable radio telephone which terminates an electronic keypad lock function upon sensing an incoming call.

While these devices fulfill their respective, particular objective and requirements, the aforementioned patents do not describe a weapon trigger lock that prevents access to a trigger of a weapon until a proper access code is entered and further allows this access code to be changed.

In this respect, the weapon trigger lock according to the present invention substantially departs from the conventional concepts and designs of the prior art, and, in doing so, provides an apparatus primarily developed for the purpose of preventing unauthorized access to a trigger of a weapon.

Therefore, it can be appreciated that there exists a continuing need for new and improved weapon trigger lock which can be used for preventing unauthorized access to a trigger of a weapon. In this regard, the present invention substantially fulfills this need.

SUMMARY OF THE INVENTION

In the view of the foregoing disadvantages inherent in the known types of trigger locks now present in the prior art, the present invention provides an improved weapon trigger lock. As such, the general purpose of the present invention, which will be described subsequently in greater detail, is to provide a new and improved weapon trigger lock and method which has all the advantages of the prior art and none of the disadvantages.

To attain this, the present invention essentially comprises, in combination, a housing formed of a primary section and a separate secondary section. The primary section has a back, a face, and a peripheral side wall interconnecting the back with the face to define a hollow interior. The secondary section has a back with a keyhole formed therethrough, a face, and a key tumbler disposed therebetween and aligned with the keyhole. Each section has a generally oval periphery. Each section has a plurality of pointed projections extended outwards from the back. The primary section and secondary section are positioned in a back-to-back configuration for holding a trigger and trigger guard of a weapon therebetween with the pointed projections. An elongated rotatable key is included and has a base end extended through the back of the primary section and into the interior thereof, a tip end extendable through the keyhole and within the tumbler of the secondary section, and a pair of diametrically opposed prongs extended outwards from the tip end. The prongs of the key are securable to the tumbler in one orientation to define a locked configuration, whereby securing the primary section to the secondary section with the key positionable between a trigger and a trigger guard of a weapon, and the prongs of the key releasable from the tumbler in another orientation, whereby allowing the primary section and secondary section to be separated for removing the key from between the trigger and trigger guard of a weapon. Random access memory circuitry is included and disposed within the interior of the primary section. The random access memory circuitry has a write mode for receiving and storing an access code signal and a read mode for transmitting a stored access code signal. A numeric keypad is included and formed of three keys backlit with light emitting diodes extended from the face of the primary section for receiving a manually input access code from a user and transmitting an access code signal. Comparator circuitry is included. The comparator circuitry is disposed within the primary section and coupled to the keypad for receiving the access code signal therefrom and coupled to the random access memory circuitry for receiving the stored access code signal therefrom. The comparator circuitry transmits a solenoid activation signal when the access code signal is equal to the stored access code signal and transmits a solenoid deactivation signal otherwise. A spring-loaded solenoid is included and disposed within the interior of the primary section and coupled to the base end of the key. The solenoid imparts rotational motion to the key upon receipt of the solenoid activation signal for placing the key in an unlocked orientation. The solenoid imparts opposite rotational motion to the key upon receipt of the solenoid deactivation signal for placing the key in a locked orientation. A depressible reprogram button mechanism is included extended from the face of the primary section. The reprogram button mechanism has a first orientation for placing the random access memory circuitry in the write mode for allowing the a new access code signal to be stored, a second orientation for placing the random access memory circuitry in the read mode, and a third orientation for preventing placement of the random access memory circuitry in the write mode upon receiving the solenoid deactivation signal. A rechargeable battery is included and disposed within the interior of the primary section and coupled to the keypad, random access memory circuitry, comparator circuitry, and solenoid for applying electrical energy thereto for operation. A recharging jack is included. The recharging jack is coupled to the battery and extended from the face of the primary section for allowing the battery to receive electrical energy for recharging. A recharging cable is included and has one end securable with an external power source for receiving electrical energy therefrom and the other end securable with the recharging jack for transmitting the electrical energy thereto. Lastly, a recharging indicator is coupled to the battery and extended from the face of the primary section for providing a visual indication that the battery is recharging. When the primary section is secured to the secondary section with the key therebetween disposed between a trigger and trigger guard of a weapon, a proper access code manually input by a user will place the key in the unlocked orientation, thus allowing the sections to be separated from the trigger and trigger guard.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved weapon trigger lock which has all the advantages of the prior art trigger locks and none of the disadvantages.

It is another object of the present invention to provide a new and improved weapon trigger lock which may be easily and efficiently manufactured and marketed.

It is a further object of the present invention to provide a new and improved weapon trigger lock which is of durable and reliable construction.

An even further object of the present invention is to provide a new and improved weapon trigger lock which is susceptible of a low cost of manufacture with regard to both materials and labor, and which accordingly is then susceptible of low prices of sale to the consuming public, thereby making such a weapon trigger lock economically available to the buying public.

Still yet another object of the present invention is to provide a new and improved weapon trigger lock which provides in the apparatuses and methods of the prior art some of the advantages thereof, while simultaneously overcoming some of the disadvantages normally associated therewith.

Even still another object of the present invention is to provide a new and improved weapon trigger lock for preventing unauthorized access to a trigger of a weapon.

Lastly, it is an object of the present invention to provide a new and improved weapon trigger lock comprising a housing formed of a primary section having an actuatable key extended therefrom and a separate secondary section having a key tumbler and with the key releasably coupled to the key tumbler for preventing access to a trigger and trigger guard of a weapon disposed between the sections; memory circuitry coupled to the housing and having a write mode for receiving and storing an access code signal and a read mode for transmitting a stored access code signal; keypad circuitry coupled the housing for receiving an input access code and transmitting an access code signal; comparator circuitry coupled to the housing for receiving the access code signal and the stored access code signal and transmitting a solenoid activation signal when the received signals are equal; solenoid circuitry coupled to the housing for releasing the key upon receipt of the solenoid activation signal; and power source means coupled the housing for supplying electrical energy to the circuitry.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
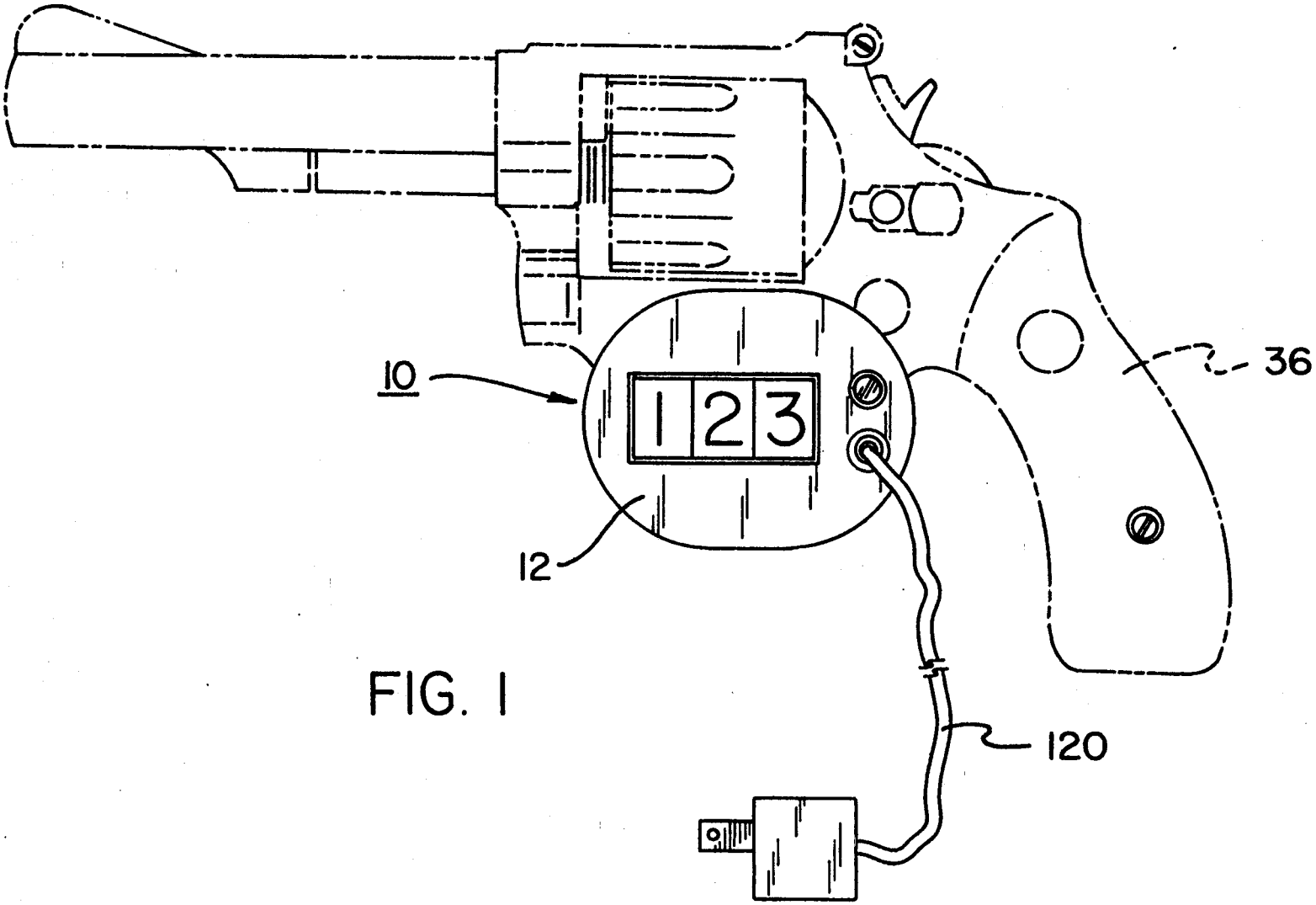
FIG. 1 is a side elevational view of the preferred embodiment constructed in accordance with the principles of the present invention secured to a trigger and trigger guard of a weapon.
Figure 2:
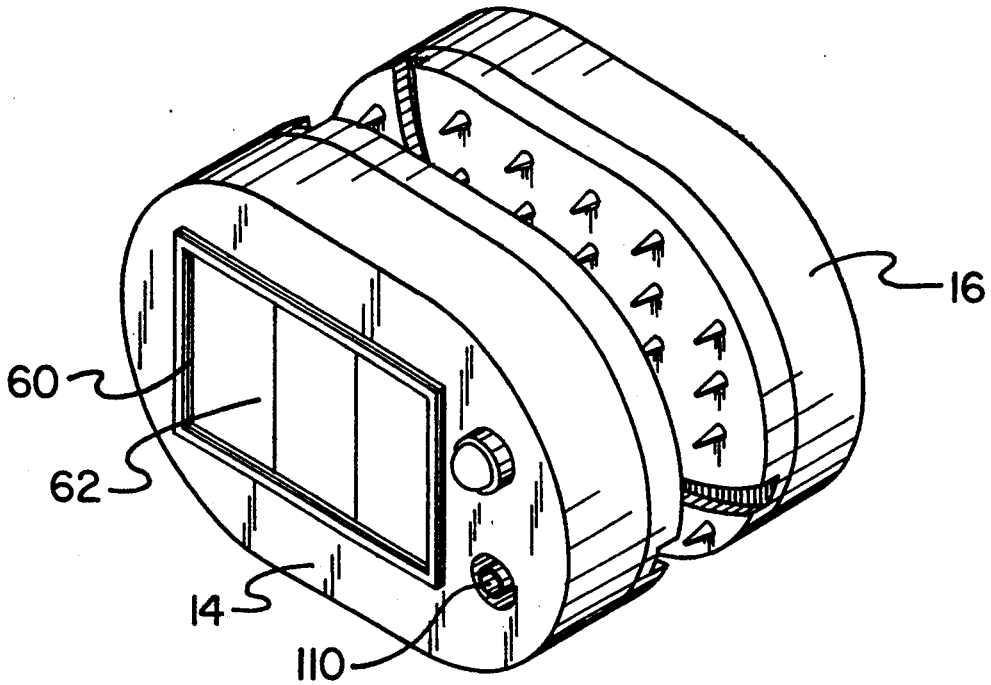
FIG. 2 is a perspective view of the present invention decoupled from a weapon.
Figure 3:
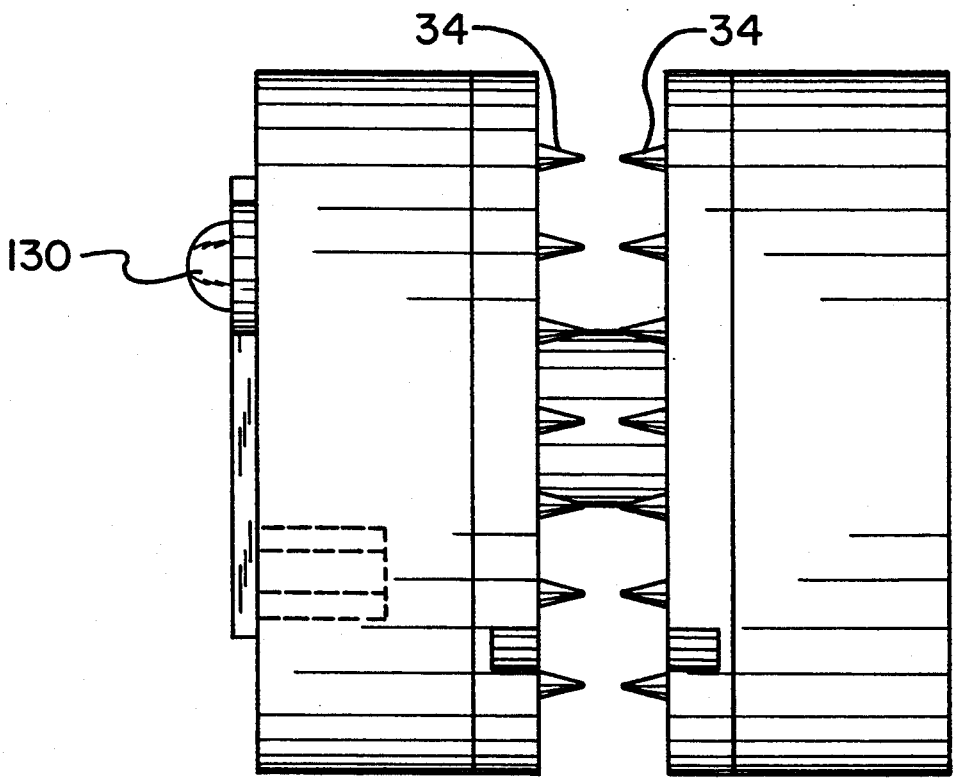
FIG. 3 is a side elevational view of the present invention.
Figure 4:
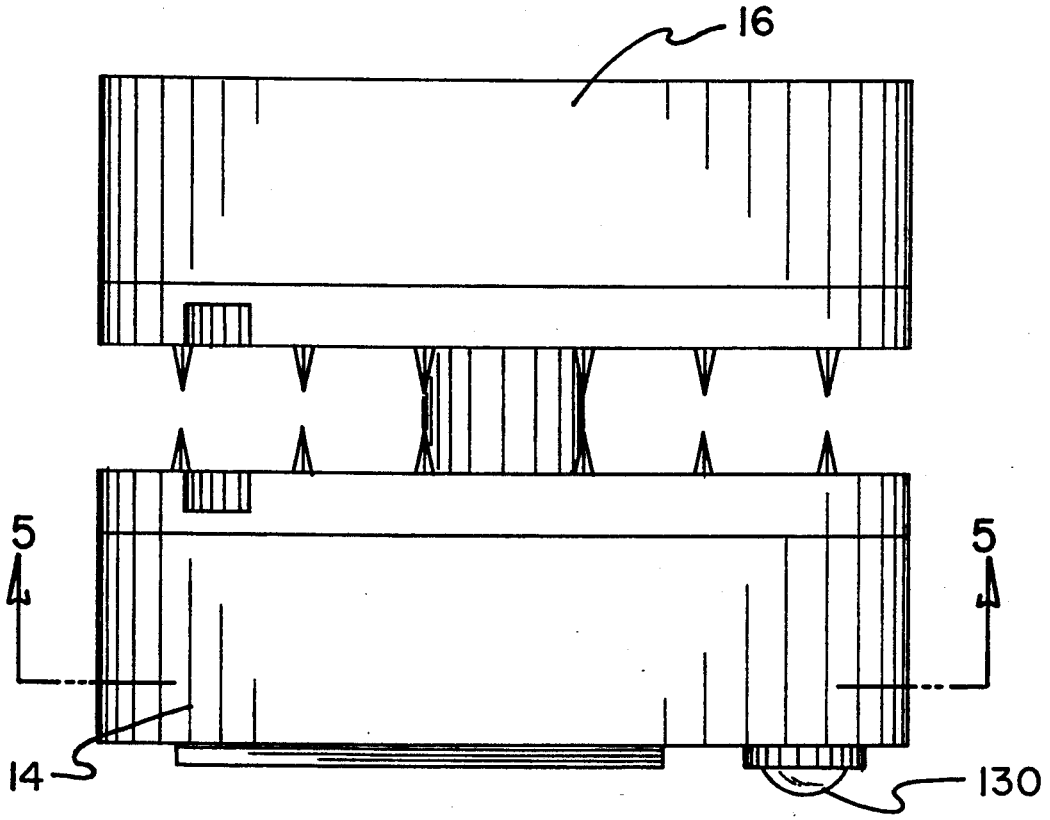
FIG. 4 is yet another side elevational view of the present invention.
Figure 5:
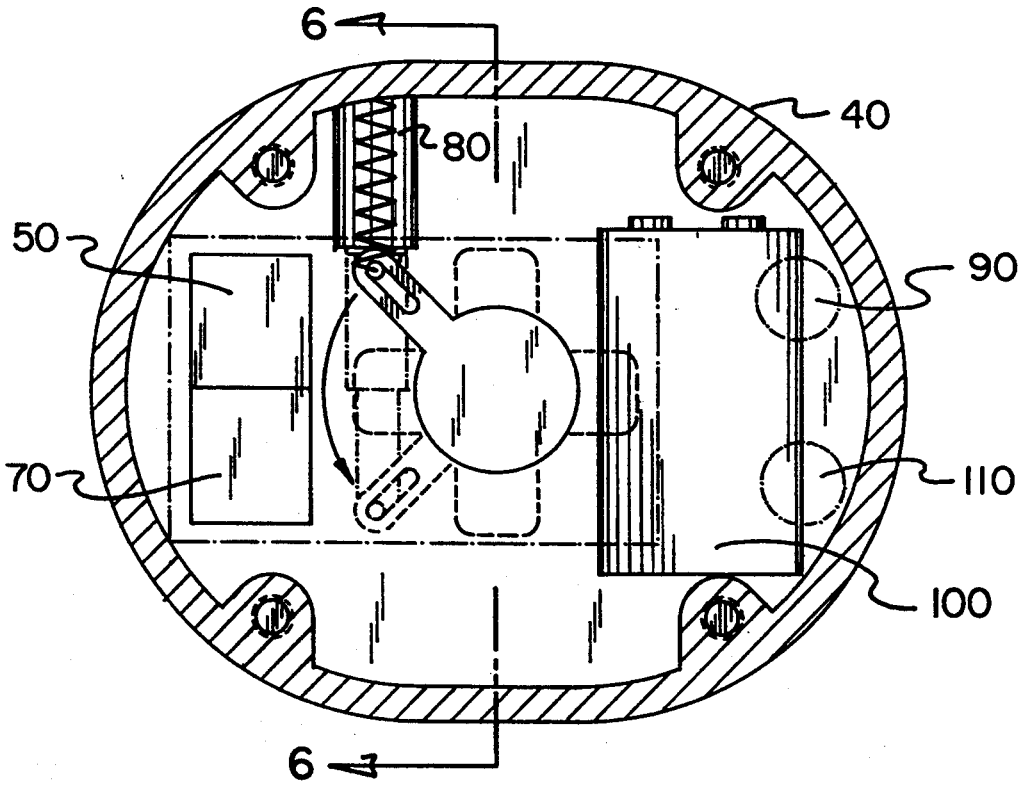
FIG. 5 is a cross-sectional view of the present invention taken along the line 5—5 of FIG. 4.
Figure 6:
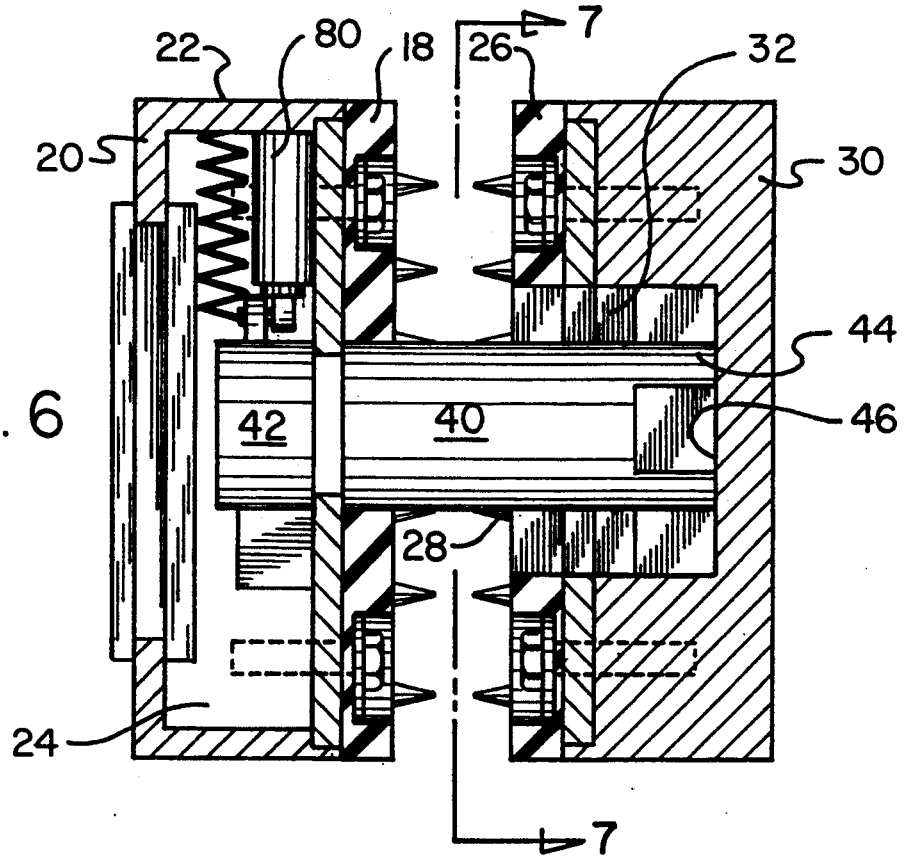
FIG. 6 is a cross-sectional view of the present invention taken along the line 6—6 of FIG. 3.
Figure 7:
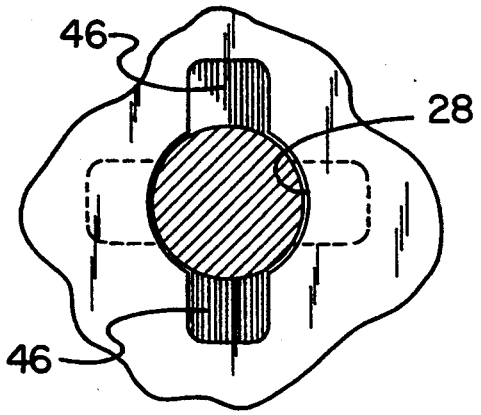
FIG. 7 is an enlarged view of the association of the key and keyhole of the present invention.
Figure 8:
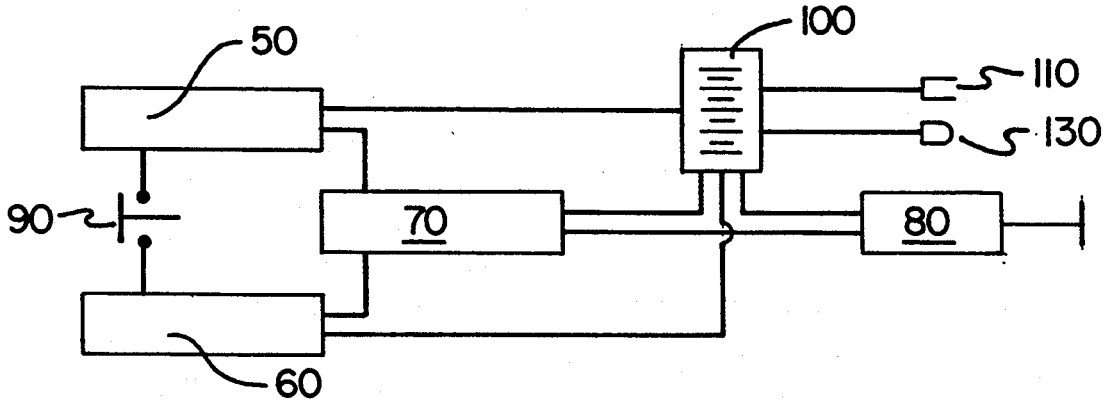
FIG. 8 is a schematic representation of the present invention.

With reference now to the drawings, and in particular, to FIG. 1 thereof, the preferred embodiment of the new and improved weapon trigger lock embodying the principles and concepts of the present invention and generally designated by the reference number 10 will be described.

Specifically, the present invention essentially includes eleven major components. The major components are the housing, key, random access memory circuitry, keypad, comparator circuitry, solenoid, reprogram button mechanism, battery, recharging jack, recharging cable, and recharging indicator. These components are interrelated to provide the intended function.

More specifically, it will be noted in the various figures that the first major component is the housing 12. The housing is formed of a primary section 14 and a separate secondary section 16. Each section is rigid in structure and formed of an elastomeric material. The primary section further includes a back 18, a face 20 and a peripheral side wall 22 interconnecting the back with the face to define a hollow interior 24. The secondary section further includes a back 26 with a keyhole 28 formed therethrough, a face 30, and a key tumbler 32 disposed therebetween and aligned with the keyhole. Each section has a generally oval periphery. Each section further includes a plate with a plurality of pointed cone-shaped projections 34 extended outwards from the back. This plate is secured to each back with bolts. The primary section and secondary section are positioned in a back-to-back configuration for holding a trigger and trigger guard of a weapon 36 therebetween using the pointed projections.

The second major component is the key 40. The key is rigid in structure and formed of metal. The key has a base end 42 extended through the back 18 of the primary section and into the interior thereof. The key is rotatable within the primary section. The key also includes a tip end 44 extendable through the keyhole 28 of the secondary section and within the tumbler 32. The key also includes a pair of diametrically opposed prongs 46 extended outwards from the tip end. The prongs are securable with the tumbler in one orientation to define a locked configuration. In the locked configuration the primary section and the secondary section are secured with the key positioned therebetween and through a trigger and trigger guard of a weapon. The prongs of the key are also releasable from the plunger in another orientation. In this orientation, the primary section and secondary section may be separated for removing the key from between the trigger and trigger guard of a weapon. Thus, the user obtains access to operate the weapon.

The third major component is the random access memory circuitry 50. The random access memory circuitry is operable when electrically energized. The random access memory circuitry is disposed within the interior of the primary section. The random access memory circuitry has a write mode for receiving and storing an access code signal and a read mode for transmitting a stored access code signal. The random access memory circuitry is conventional in design and formed with commercially available components.

The fourth major component is the numeric keypad 60. The numeric keypad is formed of three keys 62 backlit with light emitting diodes. The keypad is extended from the face of the primary section for receiving a manually input access code from a user. The keypad circuitry then transmits an access code signal based upon the input access code. The keypad is operable when electrically energized. The keypad is conventional in design and formed of commercially available components.

The fifth major component is the comparator circuitry 70. The comparator circuitry is disposed within the primary section. The comparator circuitry is coupled to the keypad 60 for receiving the access code signal therefrom. The comparator circuitry is further coupled to the random access circuitry 50 for receiving the stored access code signal therefrom. The comparator circuitry transmits a solenoid activation signal when the access code signal is equal to the stored access code signal. The comparator circuitry transmits a solenoid deactivation signal when the access code signal is not equal to the stored access code signal. The comparator circuitry is formed of conventional electronic components.

The sixth major component is the solenoid 80. The solenoid is spring-loaded. It is disposed within the interior of the primary section. The solenoid is coupled to the base end 42 of the key. The solenoid imparts rotational motion to the key upon receipt of the solenoid activation signal, thereby placing the key in an unlocked orientation in relation to the key tumbler. The solenoid further imparts opposite rotational motion to the key upon receipt of the solenoid deactivation signal, thereby placing the key in a locked orientation in relation to the key tumbler.

The seventh major component is the reprogram button mechanism 90. The reprogram button mechanism is formed with a depressible switch. The reprogram button mechanism is extended from the back face of the primary section. It has a first orientation for placing the random access memory circuitry in the write mode for allowing a new access code signal to be stored. The reprogram button mechanism also has a second orientation for placing the random access memory circuitry in the read mode. In addition, the reprogram button mechanism has a third orientation for preventing placement of the random access memory circuitry in the write mode upon receiving the solenoid deactivation signal. Thus, by placing the reprogrammed button mechanism in the first orientation, a user may enter a new code through the keypad. The reprogrammed button mechanism is positioned on the back face for preventing access thereto when the sections are locked to a weapon. When the key is placed in a locked orientation, the reprogram button mechanism is disabled. This prevents an unauthorized individual from changing the access code to gain access to a weapon when the present invention is locked thereon.

The eighth major component is the battery 100. The battery is of the rechargeable type. It is disposed within the interior of the primary section and coupled to the keypad 60, random access memory circuitry 50, comparator circuitry 70 and solenoid 80. The battery is used for supplying electrical energy for operation.

The ninth major component is the recharging jack 110. The recharging jack is coupled to the battery and extended from the face of the primary section. The recharging jack allows the battery to receive electrical energy for recharging.

The tenth major component is the recharging cable 120. The recharging cable has one end with a plug formed thereon securable with an external power source for receiving electrical energy. The other end is securable with the recharging jack for transmitting the electrical energy thereto for recharging. In the preferred embodiment the recharging cable receives power from a conventional 110 volt source.

The eleventh major component is the recharging indicator 130. The recharging indicator is coupled to the battery and extended from the face of the primary section. The recharging indicator is used for providing a visual indication that the battery is recharging. In the preferred embodiment, the recharging indicator is formed of a light emitting diode.

When the primary section is secured to the secondary section with the key therebetween disposed between a trigger and a trigger guard of a weapon, a proper access code manually input by a user will place the key in the unlocked orientation. When the key is placed in the unlocked orientation, the sections may be separated from the trigger and trigger guard.

This present invention provides an improved method for locking a gun and thus preventing it unauthorized use, yet provides quick and easy access to authorized users. The present invention utilizes a standard method of mechanically locking the gun's trigger in place, while incorporating an electronic keypad that is 1 inch wide by 3 inches long. The present invention is equipped with a keypad that remains illuminated at all times and flashes when the battery is low. The user inputs a pre-programmed 4-digit code into the keypad to unlock a weapon held therein. This code can be reprogrammed using the reprogram button. The reprogram button is non-functional when the device is locked on the gun. A comparator circuit compares the code entered to the code programmed to decide if the solenoid will become energized, thereby enabling the key to rotate to the unlocked position. The unit also comes with a charging jack and rechargeable battery. The present invention enables the owner of a weapon to store it fully loaded. The present invention also lets an authorized user gain access to a weapon locked therein almost immediately, instead of scrambling to find a key when there is danger.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A weapon trigger lock for preventing unauthorized access to a trigger of a weapon comprising, in combination:

a housing formed of a primary section and a separate secondary section, the primary section further having a back, a face, and a peripheral side wall interconnecting the back with the face to define a hollow interior, the secondary section further having a back with a keyhole formed therethrough, a face, and a key tumbler disposed therebetween and aligned with the keyhole, each section having a generally oval periphery, each section further having a plurality of pointed projections extended outwards from the back, the primary section and secondary section positioned in a back-to-back configuration for holding a trigger and trigger guard of a weapon therebetween;

an elongated rotatable key having a base end extended through the back of the primary section and into the interior thereof, a tip end extendable through the keyhole and within the tumbler of the secondary section, and a pair of diametrically opposed prongs extended outwards from the tip end and with the prongs securable to the tumbler in one orientation to define a locked configuration, whereby securing the primary section to the secondary section with the key positionable between a trigger and a trigger guard of a weapon, and the prongs of the key releasable from the tumbler in another orientation, whereby allowing the primary section and secondary section to be separated for removing the key from between the trigger and trigger guard of a weapon;

random access memory circuitry disposed within the interior of the primary section, the random access memory circuitry having a write mode for receiving and storing an access code signal and a read mode for transmitting a stored access code signal;

a numeric keypad formed of three keys backlit with light emitting diodes extended from the face of the primary section for receiving a manually input access code from a user and transmitting an access code signal;

comparator circuitry disposed within the primary section and coupled to the keypad for receiving the access code signal therefrom and coupled to the random access memory circuitry for receiving the stored access code signal therefrom, the comparator circuitry transmitting a solenoid activation signal when the access code signal is equal to the stored access code signal and transmitting a solenoid deactivation signal otherwise;

a solenoid disposed within the interior of the primary section and coupled to the base end of the key, the solenoid imparting rotational motion to the key upon receipt of the solenoid activation signal for placing the key in an unlocked orientation, the solenoid imparting opposite rotational motion to the key upon receipt of the solenoid deactivation signal for placing the key in a locked orientation;

a depressible reprogram button mechanism extended from the back of the primary section and having a first orientation for placing the random access memory circuitry in the write mode for allowing a new access code signal to be stored, a second orientation for placing the random access memory circuitry in the read mode, and a third orientation for preventing placement of the random access memory circuitry in the write mode upon receiving the solenoid deactivation signal;

a rechargeable battery disposed within the interior of the primary section and coupled to the keypad, random access memory circuitry, comparator circuitry, and solenoid for applying electrical energy thereto for operation;

a recharging jack coupled to the battery and extended from the face of the primary section for allowing the battery to receive electrical energy for recharging;

a recharging cable having one end securable with an external power source for receiving electrical energy therefrom and the other end securable with the recharging jack for transmitting the electrical energy thereto; and a recharging indicator coupled to the battery and extended from the face of the primary section for providing a visual indication that the battery is recharging;

whereby when the primary section is secured to the secondary section with the key therebetween disposed between a trigger and trigger guard of a weapon, a proper access code manually input by a user will place the key in the unlocked orientation, thus allowing the sections to be separated from the trigger and trigger guard.

2. A weapon trigger lock comprising:

a housing formed of a primary section having an actuatable key extended therefrom and a separate secondary section having a key tumbler and with the key releasably coupled to the key tumbler for preventing access to a trigger and trigger guard of a weapon disposed between the sections;

memory circuitry coupled to the housing and having a write mode for receiving and storing an access code signal and a read mode for transmitting a stored access code signal;

keypad circuitry coupled to the housing for receiving an input access code and transmitting an access code signal;

comparator circuitry coupled to the housing for receiving the access code signal and the stored access code signal and transmitting a solenoid activation signal when the received signals are equal;

solenoid circuitry coupled to the housing for releasing the key upon receipt of the solenoid activation signal; and power source means coupled the housing for supplying electrical energy to the circuitry.

3. The weapon trigger lock as set forth in claim 2 further including reprogramming circuitry coupled to the memory circuitry and keypad circuitry for allowing the access code signal stored in the memory circuitry to be changed.

4. The weapon trigger lock as set forth in claim 2 wherein the power source means comprises:

a rechargeable battery coupled to the keypad circuitry, memory circuitry, comparator circuitry, and solenoid circuitry for applying electrical energy thereto for operation;

a recharging jack coupled to the battery for allowing the battery to receive electrical energy for recharging;

a recharging cable having one end securable with an external power source for receiving electrical energy therefrom and the other end securable with the recharging jack for transmitting the electrical energy thereto; and a recharging indicator coupled to the battery for providing a visual indication that the battery is recharging.

* * * * *